US006478463B2

(12) United States Patent
Snider

(10) Patent No.: US 6,478,463 B2
(45) Date of Patent: Nov. 12, 2002

(54) TOOL STORAGE BAG

(75) Inventor: Gregory Scott Snider, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/909,133

(22) Filed: Jul. 19, 2001

(65) Prior Publication Data

US 2002/0015538 A1 Feb. 7, 2002

Related U.S. Application Data

(60) Provisional application No. 60/222,687, filed on Aug. 2, 2000.

(51) Int. Cl.[7] ..... B65D 33/06

(52) U.S. Cl. ..... 383/18; 383/121.1; 206/373; 224/610

(58) Field of Search ..... 383/15, 16, 18, 383/19, 121.1; 206/373, 372; 224/612, 610, 607; 190/109, 111, 115, 116, 117

(56) References Cited

U.S. PATENT DOCUMENTS

| | | | | | |
|---|---|---|---|---|---|
| 676,659 | A | * | 6/1901 | Mogg | 383/18 |
| 900,094 | A | | 10/1908 | Fisher | |
| 918,837 | A | | 4/1909 | Fisher | |
| 962,595 | A | * | 6/1910 | Smith | 383/39 X |
| 1,176,266 | A | | 3/1916 | Batchelder | |
| 1,251,404 | A | | 12/1917 | Mills | |
| 1,296,421 | A | * | 3/1919 | Miller et al. | 206/373 X |
| 1,359,461 | A | | 11/1920 | Luce | |
| 1,426,814 | A | * | 8/1922 | Bruns | 383/121.1 |
| 1,594,724 | A | * | 8/1926 | Hansen | 383/18 X |
| 1,617,629 | A | * | 2/1927 | Gale | 383/18 |
| 1,841,154 | A | * | 1/1932 | Rath | 190/111 X |
| 2,067,851 | A | * | 1/1937 | Lifton | 190/109 |
| 2,377,311 | A | | 6/1945 | Campbell | |
| 2,502,486 | A | | 4/1950 | Savrin | |
| 2,515,316 | A | * | 7/1950 | Schjeldrup | 383/16 X |
| 2,554,004 | A | | 5/1951 | Bergstein | |
| 2,577,670 | A | * | 12/1951 | Adams | 190/111 |
| 3,181,751 | A | | 5/1965 | Wilson | |
| 3,301,453 | A | | 1/1967 | Stewart | |
| 3,347,299 | A | | 10/1967 | Alexander | |
| D222,951 | S | | 2/1972 | Stringer | |
| 4,082,208 | A | | 4/1978 | Lane, Jr. | |
| 4,140,164 | A | | 2/1979 | Staup | |
| 4,210,186 | A | * | 7/1980 | Belenson | 383/18 X |
| 4,703,517 | A | | 10/1987 | Marino | |
| 4,738,547 | A | | 4/1988 | Brown | |
| 4,812,054 | A | | 3/1989 | Kirkendall | |
| 4,836,374 | A | | 6/1989 | Hutchins et al. | |
| 4,899,887 | A | * | 2/1990 | Cachero | 190/109 X |

(List continued on next page.)

FOREIGN PATENT DOCUMENTS

| | | | | | |
|---|---|---|---|---|---|
| DE | 3220496 | C2 | | 12/1983 | |
| DE | G8811505.4 | | | 12/1988 | |
| DE | G9101678.9 | | | 6/1991 | |
| DE | 4005311 | C2 | | 9/1991 | |
| DE | 4322534 | A1 | | 1/1994 | |
| EP | 0327140 | A2 | | 8/1989 | |
| EP | 0574101 | A1 | | 12/1993 | |
| EP | 0760787 | B1 | | 3/1997 | |
| FR | 1009874 | A | | 6/1952 | |
| FR | 2643343 | | * | 8/1990 | 383/18 |
| GB | 0339825 | | * | 12/1930 | 383/18 |

*Primary Examiner*—Jes F. Pascua
(74) *Attorney, Agent, or Firm*—Harness, Dickey & Pierce, P.L.C.

(57) ABSTRACT

A tool storage bag is provided for storing tools and accessories at a work site. The tool storage bag has straps that allow for even distribution of the load during transit. The bag also includes a wear-resistant pocket design and a reinforced bottom construction.

1 Claim, 5 Drawing Sheets

U.S. PATENT DOCUMENTS 5,518,315 A 5/1996 Nichols
D376,454 S 12/1996 Fierek et al.
5,605,112 A * 2/1997 Schuman ..... 383/16 X
5,653,318 A * 8/1997 Field ..... 383/121.1 X
5,653,337 A 8/1997 Cirigliano
D383,601 S 9/1997 Jones et al.
5,725,090 A * 3/1998 Vermillion et al. ..... 190/111 X
5,813,445 A 9/1998 Christman
5,873,504 A 2/1999 Farmer
5,941,195 A * 8/1999 Martz ..... 190/112 X
D417,079 S 11/1999 Heltzel
6,076,715 A 6/2000 Easter
6,126,003 A * 10/2000 Brouard ..... 206/372
6,189,697 B1 * 2/2001 Davis ..... 383/39 X
D447,340 S * 9/2001 Snider ..... D3/276

* cited by examiner

TOOL STORAGE BAG

This application claims the benefit of Ser. No. 60/222,687, filed Aug. 2, 2000.

FIELD OF THE INVENTION

The present invention relates generally to storage bags and more specifically to worksite storage bags designed to hold and protect various tools and accessories.

BACKGROUND

It is known in the art to produce a bag that is required to carry substantial loads for various situations. These bags have numerous designs for various specific functions. However, these designs fail to address many concerns for a bag in use at a construction site.

Generally, many prior bag designs are made out of a unitary material that creates an enclosure. These bags, though good for light loads, are not well suited for carrying larger loads that require a great deal of strength. However, disclosures such as U.S. Pat. No. 5,518,315 disclose a frame attached to the bottom of a bag. This frame, though providing some support to the bottom of the bag, does not disclose a device that would provide superior protection to destruction of items in a bag and protect items from moisture damage.

Furthermore, the handles of bags are generally left to simply sitting on the outside walls of the bag, this can reduce the durability of the handles and the ability to carry extremely heavy loads. However, it is desirous to more integrally associate the handles with the bag. Handles that are simply affixed to the walls of the bag pose the possibility of tearing lose.

SUMMARY OF THE INVENTION

It is an object of the present invention to provide a handle system for a bag that may carry a heavy load without breaking or tearing away from the bag to which the handles are attached.

It is another object of the present invention to provide a storage bag which is large and strong enough to carry heavy loads.

A third object of the present invention is to provide a bag with a storage compartment reinforced with a base portion that is both durable and resistant to the elements such as water.

Yet another object of the present invention is to provide a storage bag that has additional storage pockets such that the seems of the pockets are resistant to wear due to grinding from debris and dirt within the pocket.

The present invention is a heavy-duty storage bag, especially for use at a construction work site. The present invention discloses a handle and strap system that surrounds the entire bag allowing for even weight distribution and long term durability. Furthermore, the bag is provided with pockets that are of a heavy-duty construction and affixed to the bag in such a way as to create a distance from the bottom of the pocket thus reducing wear due to debris. Another embodiment of the present invention provides a bottom for a bag that is both durable and resilient to elements such as moisture.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
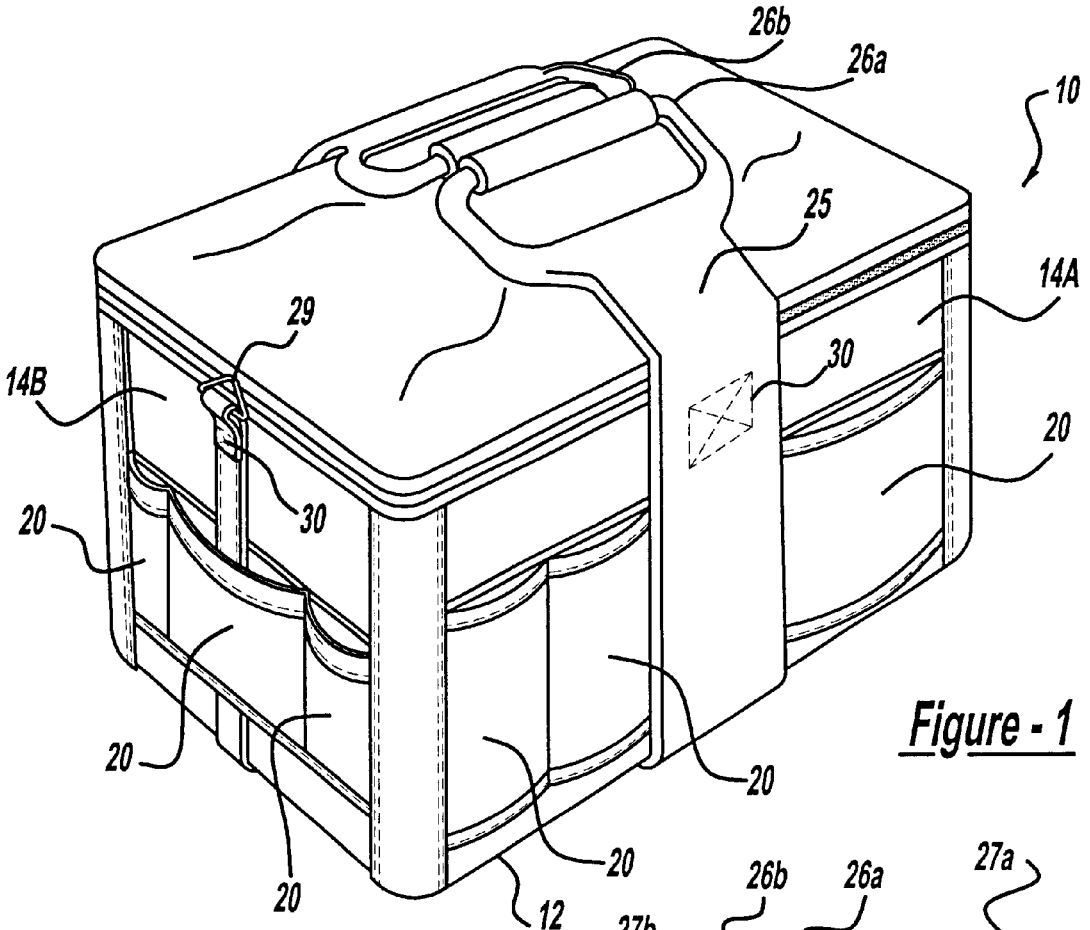
FIG. 1 is a perspective view of the tool storage bag according to the present invention.
Figure 2:
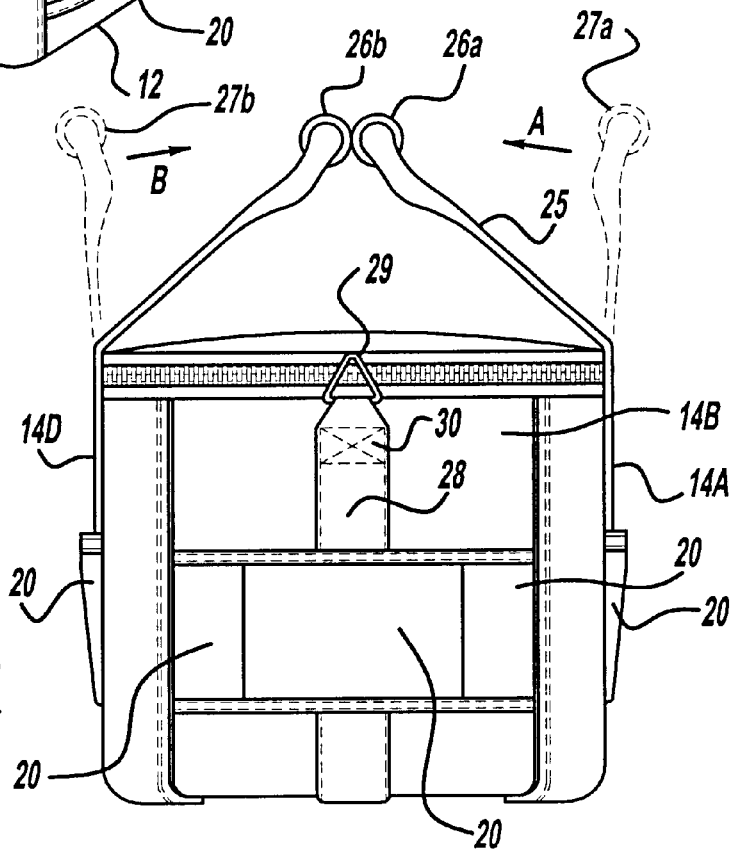
FIG. 2 is an end view of the tool storage bag according to the present invention.
Figure 3:
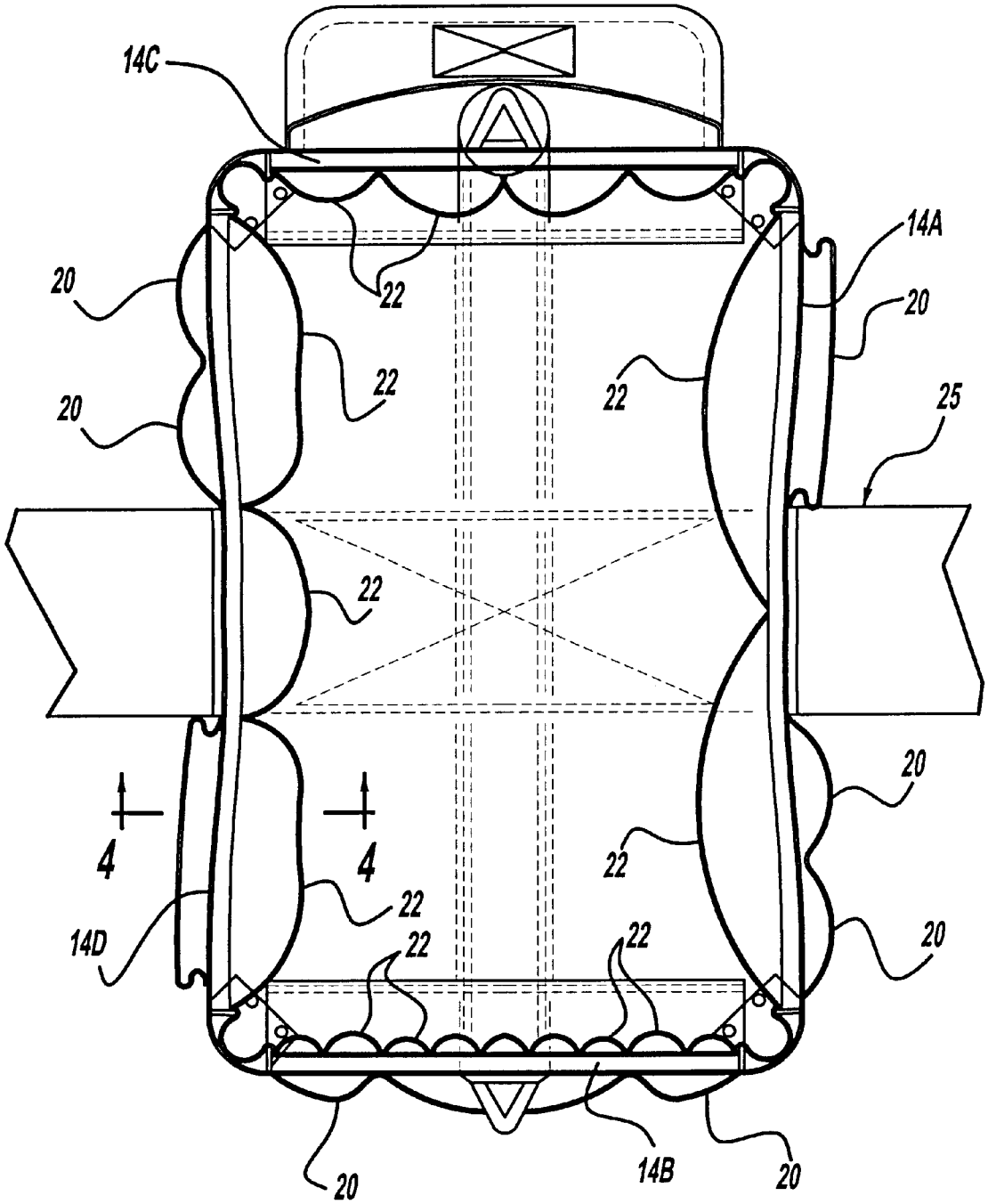
FIG. 3 is a plan view of the interior of the tool storage bag according to the present invention including a cross-sectional view of side pockets of the worksite storage bag according to the present invention.

A tool storage bag 10, as is illustrated in FIGS. 1–5, includes a base 12 and generally vertical sidewalls 14A–14D which are formed of a ballistic nylon inner and outer shell having open cell urethane disposed therebetween. A cover 16 is attached to the sidewall 14D by a fabric hinge. A zipper 18 is provided along sidewalls 14A–14C for securing the cover 16 in a closed position. The tool storage bag 10 is designed for storing tools and accessories and includes a plurality of exterior pockets 20 disposed on the exterior surface and an additional plurality of interior pockets 22 (as shown in FIG. 3) disposed on an interior surface of the sidewalls 14A–14D. The pockets 20,22 are formed through stitching material to the sidewalls 14A–14D. The sidewalls 14A–14D are spaced a distance apart so as to create a large footprint for the tool storage bag 10. This large footprint allows for the storage of numerous tools of various sizes not currently accommodated by other storage bags. Furthermore, the pockets 20,22 allow for additional storage of tools and their attendant accessories.

With continuing reference to FIG. 1 and additional reference to FIGS. 2–3, the tool storage bag 10 additionally includes a first leather strap portion 25 that extends along sidewall 14A, the base 12 and sidewall 14D. The first leather strap 25 terminates in uniquely designed handles **26*a*, 26*b*, described below. A second leather strap 28 extends from sidewall 14B, the base 12 and sidewall 14C and crossing the first leather strap 25 on the base 12. The second leather strap 28 terminates at both ends in metal loops 29 which are designed to be engaged by a shoulder strap (not shown). The ends of leather straps 25,28 are stitched to the sidewalls 14A–14D by a boxstitch 30 and to the base 12 of the storage bag 10. Furthermore, the leather straps 25,28 provide even weight distribution for ease of transport and storage. The leather straps 25,28 in traversing, as one piece, the entire distance along the sidewalls and base of the storage bag 10 ensure that the weight of the storage bag 10** is not shifted unevenly.

With continuing reference to FIG. 1 and particular reference to FIG. 2 the unique handles **26*a*, 26*b* may be seen. The handles 26*a*, 26*b* have hook-and-loop fasteners 27*a*, 27*b* on the innermost sides for attaching the handles 26*a*, 26*b*** together when carrying or storing the worksite storage bag

10. The handles 26*a,* 26*b* may be fastened together to allow ease of storage and transport. Furthermore, having the handles 26*a,* 26*b* secured on top of the tool storage bag 10 can increase safety at a work site and during transport.

Figure 4:
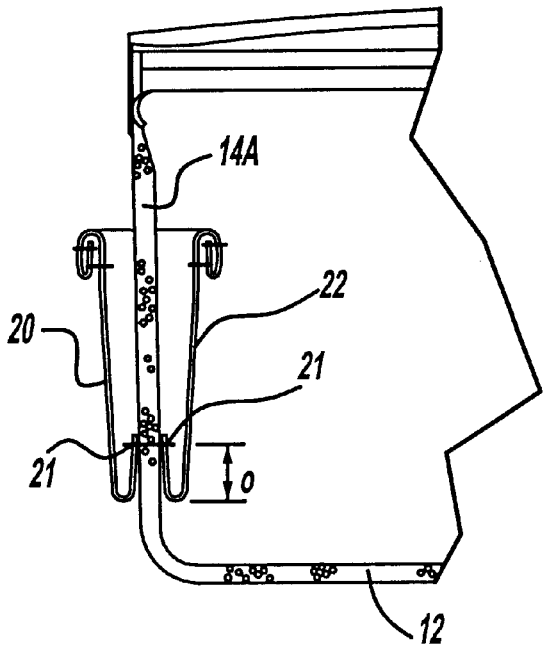
FIG. 4 is a cross-sectional view taken along line 4—4 of FIG. 3.
Figure 5:
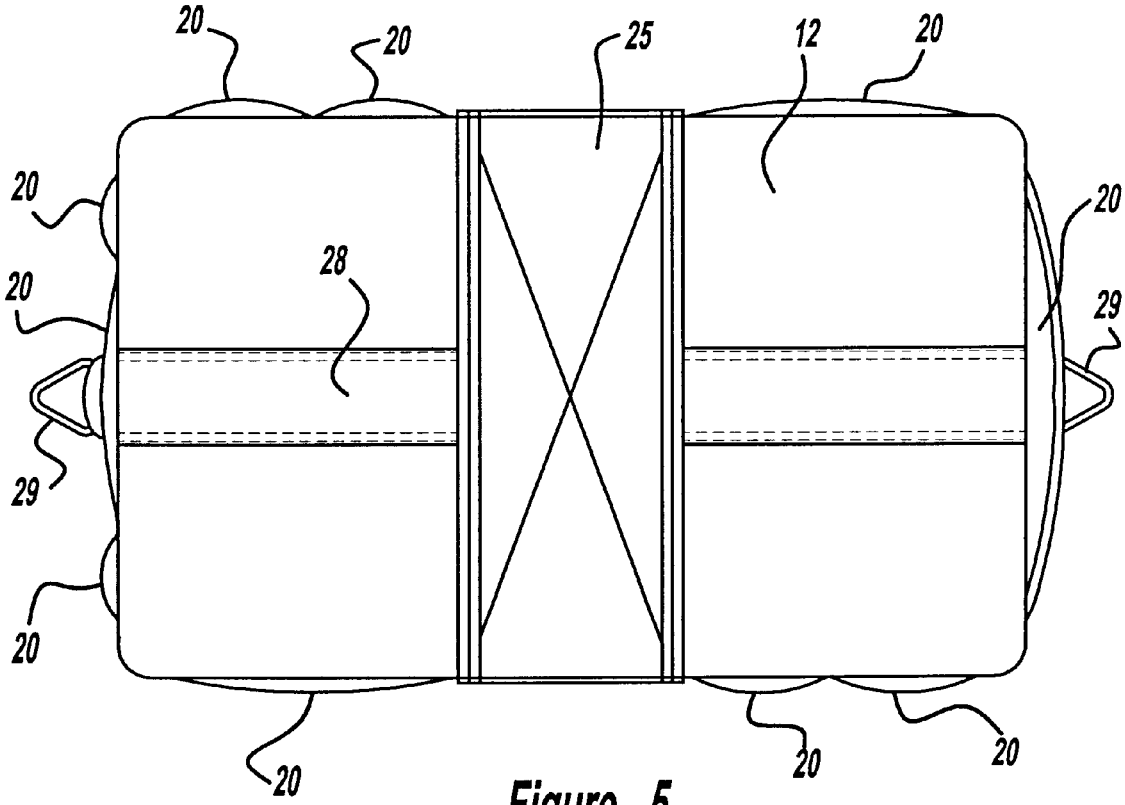
FIG. 5 is a bottom view of the tool storage bag according to the present invention.

Now turning particular reference to FIGS. 3 and 4, the inner pockets 20 and exterior pockets 22 which are sewn to the inner and outer surfaces of the sidewalls 14A–14D can be seen in detail. The pockets 20,22 are disposed around the interior and exterior of the tool storage bag 10. The plurality of pockets 20,22 allow for extreme flexibility in storage of items and for increased storage capacity. The pockets 20,22 are provided with a lower seam 21 which is spaced a distance D above the pocket bottom 20*a,* 22*a.* This distance D up the sidewalls 14A–14D will allow sand and other grit to fall to the pocket bottom 20*a,* 22*a* and not affect the seam 21. In not affecting the seam 21 the seam 21 may have a longer wear life and increased value to the consumer.

Figure 6:
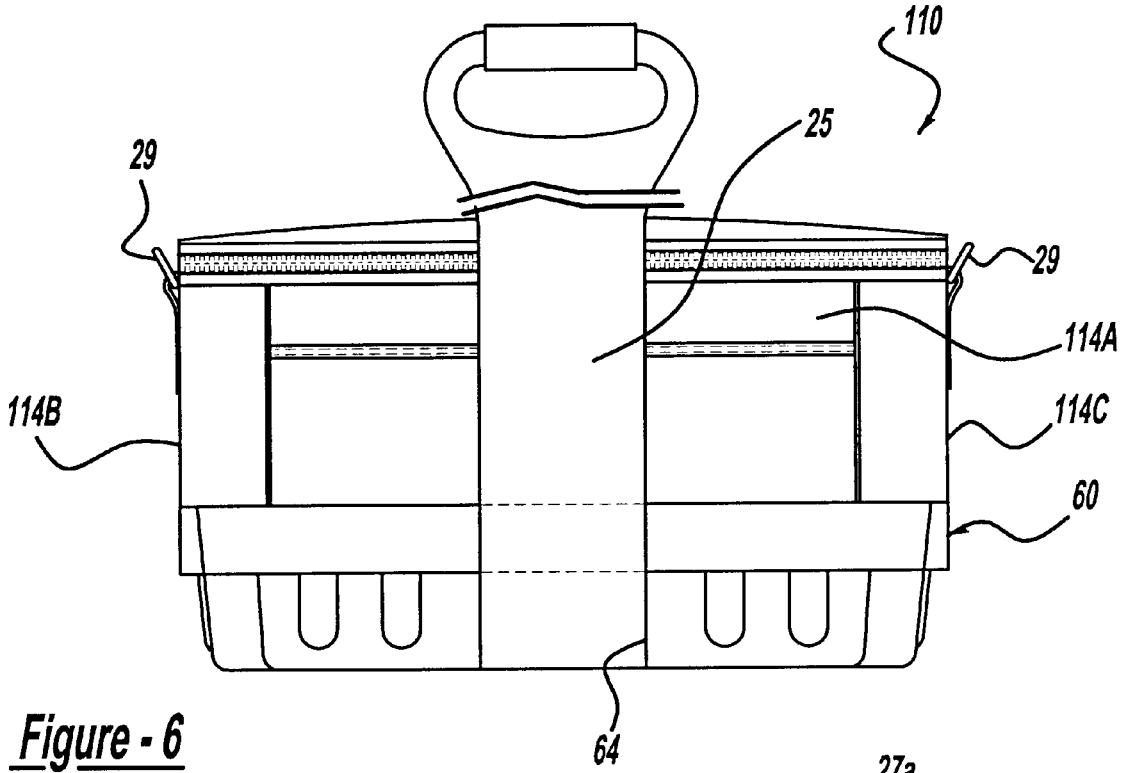
FIG. 6 is a plan view of a front of a worksite storage bag according to an alternate embodiment of the present invention.
Figure 7:
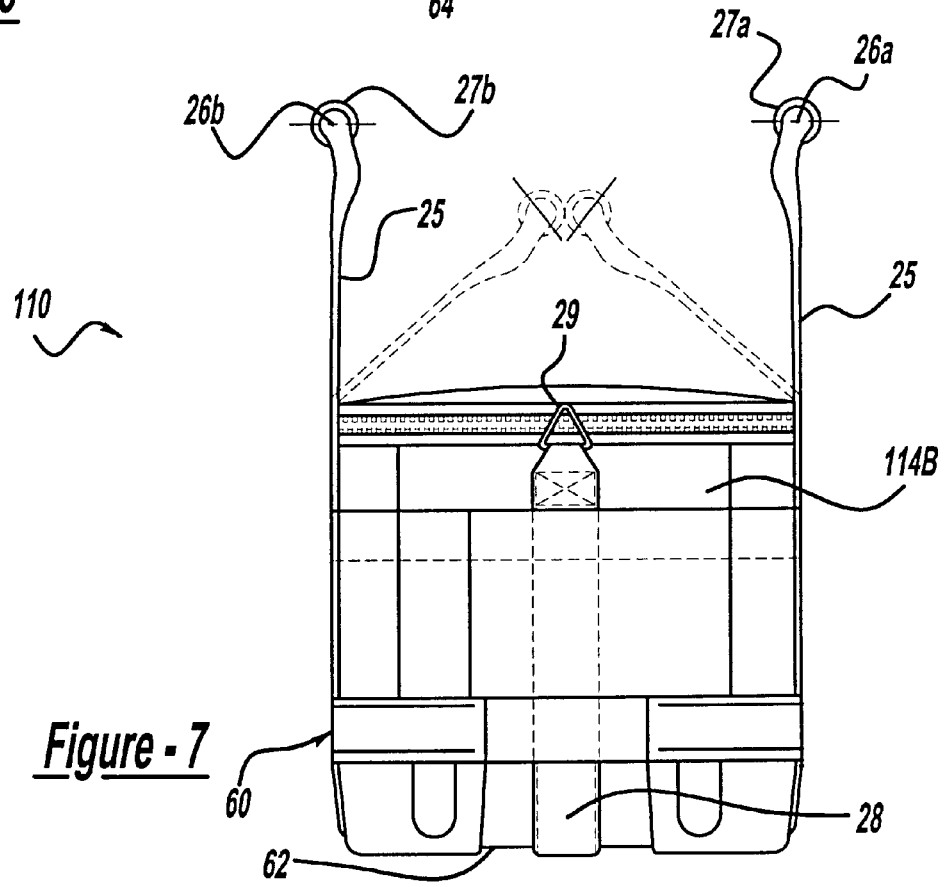
FIG. 7 is a plan view of a side of a worksite storage bag according to an alternate embodiment of the present invention.
Figure 8:
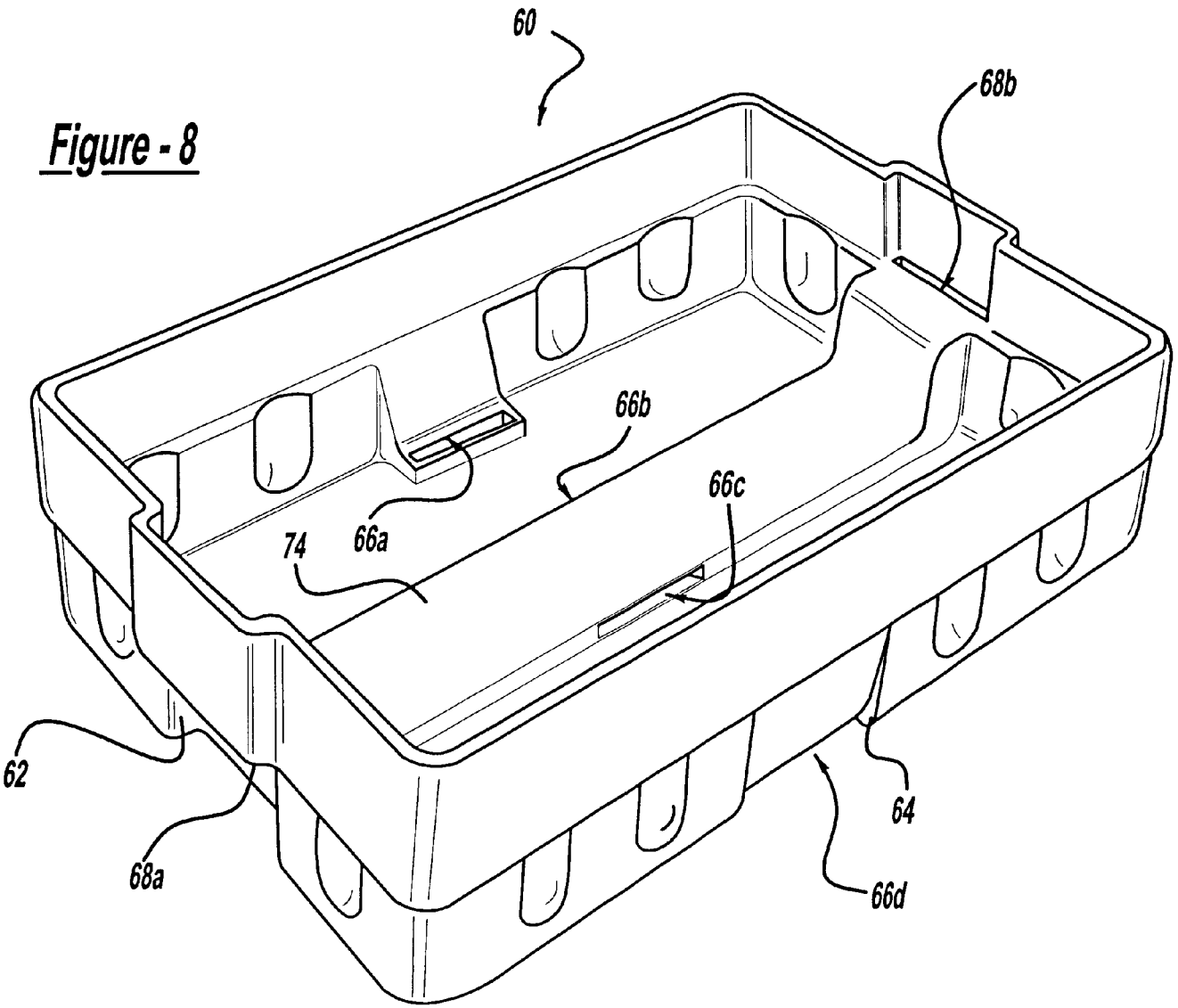
FIG. 8 is a perspective view of a tray bottom of a worksite storage bag according to the present invention.

With reference to FIGS. 6–8 an alternate embodiment of the tool storage bag 110 is provided with a plastic bottom or tray 60 which is sewn to the sidewalls 14A–14D. The storage bag 110 as indicated in FIGS. 6 and 7 is disposed within the tray 60. Thus the storage bag 110 includes a base and sidewalls 114A–114D that extend to the bottom of the tray 60. The tray 60 is provided with recesses 64 for receiving the first leather strap 125 and further recesses 62 for receiving the second leather strap 128. The tray 60 receives the bottom of the storage bag 110 providing increased stability and increased wear resistance to the bottom of the storage bag 110. Furthermore, the tray 60 is constructed of a suitable plastic or rubber which will also resist dampness which may be present at several worksites. This resistance to dampness will help increase the lifetime of tools stored in the storage bag 110 by resisting corrosion that may occur due to dampness that would otherwise soak through the storage bag 110.

Now turning with particular reference to FIG. 8, the recesses 62 and 64 which receive the first leather strap 125 and the second leather strap 128 allow for a close fit of the leather straps 125,128. This ensures that the leather traps 125,128 will not lose their grip on the storage bag 110 as it is moved from location to location. Furthermore, the recesses 62,64 may increase the wear time of the straps as well removing sharp edges which may be exposed if the leather straps 125,128 were not allowed to recess under the storage bag 10. The tray 60 also includes a plurality of openings 66*a*–66*d* and 68*a*–68*b* which are formed to receive the leather straps 125,128. The first leather strap 125 is received first through opening 66*a,* extends across the bottom of the tray 60, then under the bottom channel 74 through opening 66*b,* then back through opening 66*c* across the bottom of the tray 60, and finally exiting the tray 60 through opening 66*d* where it extends upward along the sidewall of the tray. In this way the first leather strap 25 travels from the outside of the tray into the tray 60 and exits the tray again. This serpentine path ensures that the first leather strap 125 will never disengage the tray 60 thus further assuring that the storage bag 110 is securely held by the first leather strap 125. The second leather strap 128 is received first by opening 68a extends below the channel 74, while also being received into the channel 74, crossing the first leather strap 125 and then is received by opening 68*b.* In this manner the second leather strap 128 is disposed on the inside and the outside of the tray 60 as well further ensuring a secure hold upon the tray 60 and the tool storage bag 110.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A storage bag comprising:

a bottom panel;

a plurality of sidewalls each having a bottom edge attached to said bottom panel and having an outside and an inside surface;

a top panel attached to at least one of said plurality of sidewalls;

a handle strap having a first and second end, wherein said handle strap extends below said bottom panel and along two of said sidewalls, said first and second ends each forming a handle;

a tray affixed to said plurality of sidewalls; and a second strap having a first and second end, wherein said second strap extends below said tray and crosses over said handle strap in a generally perpendicular direction, said first and second ends of said second strap each being sewn to opposing ones of said plurality of side walls and supporting a shoulder harness loop, said tray including at least one channel to receive said second strap.

* * * * *